US009336664B2

(12) United States Patent
Na

(10) Patent No.: US 9,336,664 B2
(45) Date of Patent: May 10, 2016

(54) CRIME PREVENTION SYSTEM USING SENSOR MODULE

(71) Applicant: AMBUS CO., LTD., Yongin-si (KR)

(72) Inventor: Kee Woon Na, Yongin-si (KR)

(73) Assignee: AMBUS CO., LTD. (KR)

( * ) Notice: Subject to any disclaimer, the term of this patent is extended or adjusted under 35 U.S.C. 154(b) by 145 days.

(21) Appl. No.: 14/349,486

(22) PCT Filed: Oct. 11, 2012

(86) PCT No.: PCT/KR2012/008265
§ 371 (c)(1),
(2) Date: Jun. 3, 2014

(87) PCT Pub. No.: WO2013/055124
PCT Pub. Date: Apr. 18, 2013

(65) Prior Publication Data

US 2014/0266722 A1 Sep. 18, 2014

(30) Foreign Application Priority Data

Oct. 12, 2011 (KR) ..... 10-2011-0103981

(51) Int. Cl.
*G08B 13/00* (2006.01)
*G08B 13/12* (2006.01)
*G08B 13/08* (2006.01)

(52) U.S. Cl.
CPC ..... *G08B 13/12* (2013.01); *G08B 13/08* (2013.01)

(58) Field of Classification Search
CPC .... G08B 13/08; G08B 13/12; G08B 13/1454; G08B 13/128; G08B 13/1418; G08B 13/1436; G08B 13/1463; E05B 37/025; E05B 45/005; E05B 67/006; Y10T 70/435; Y10S 70/49; G01C 9/02; G01C 9/06; G01C 9/10
USPC ..... 340/541
See application file for complete search history.

(56) References Cited

U.S. PATENT DOCUMENTS 5,748,083 A * 5/1998 Rietkerk ..... G08B 13/128 340/568.2
5,786,759 A * 7/1998 Ling ..... B62J 3/00 340/542
7,937,846 B2 * 5/2011 Ozawa ..... G01C 9/02 33/365
8,181,354 B2 * 5/2012 Ozawa ..... G01C 9/02 33/365
2003/0122672 A1 * 7/2003 Billiard ..... G08B 13/1454 340/568.2

(Continued)

FOREIGN PATENT DOCUMENTS

JP 11101638 4/1999
JP 11185187 7/1999

(Continued)

OTHER PUBLICATIONS

International Search Report—PCT/KR2012/008265 dated Feb. 19, 2013.

*Primary Examiner* — John A Tweel, Jr.
*Assistant Examiner* — Adnan Aziz
(74) *Attorney, Agent, or Firm* — Cantor Colburn LLP

(57) ABSTRACT

Provided is a crime prevention system using a sensor module capable of sensing all directions. The crime prevention system using a sensor module may be applied to buildings in which internal structures and crime prevention environments are various, have relatively low power consumption, and be simply installed.

9 Claims, 17 Drawing Sheets

(56) References Cited

U.S. PATENT DOCUMENTS

| | | | | |
|---|---|---|---|---|
| 2004/0070493 | A1* | 4/2004 | Veziris | B60R 16/0233 340/441 |
| 2006/0244576 | A1* | 11/2006 | Sugie | B60R 25/1004 340/429 |
| 2009/0223265 | A1* | 9/2009 | Chang | B60R 25/1004 70/419 |
| 2009/0266168 | A1* | 10/2009 | Shimase | G01C 9/10 73/649 |
| 2010/0302025 | A1* | 12/2010 | Script | G01P 15/09 340/539.1 |
| 2014/0109631 | A1* | 4/2014 | Asquith | E05B 45/005 70/15 |
| 2014/0284238 | A1* | 9/2014 | Clinton | B65D 85/60 206/457 |

FOREIGN PATENT DOCUMENTS

| | | | |
|---|---|---|---|
| JP | 11316881 | A * | 11/1999 |
| KR | 1020020087923 | | 11/2002 |
| KR | 100959896 | | 5/2010 |
| KR | 100962868 | | 5/2010 |
| KR | 101005350 | | 12/2010 |

* cited by examiner

CRIME PREVENTION SYSTEM USING SENSOR MODULE

TECHNICAL FIELD

The present invention relates to a crime prevention system, and more particularly, to a crime prevention system using a sensor module capable of being cheaply manufactured and sensing all directions.

BACKGROUND ART

Generally, a crime prevention system indicates a system of granting entrance and exit authority for a protection area and informing a service provider of a risk situation such as fire and leakage of gas to allow the service provider to rapidly take a corresponding action, thereby minimizing property damage and providing a compensation basis for legal treatment when casualties are confirmed.

This crime prevention system for safety of a property and life has been continuously developed in accordance with advance of an information communication technology.

Therefore, a crime prevention level of public and commercial buildings has become high, while a crime prevention level of a residence building is still low.

That is, since the crime prevention system has been mainly developed in connection with the public and commercial buildings in which people are not present at night, it may not be applied to the residence building in which many people are present at night.

FIG. 1 shows an 'infrared sensor' according to the related art.

As shown in FIG. 1, the 'infrared sensor' disclosed in Korean Patent No. 10-1005350 is characterized in that it is configured to include an external case 20 opened in a length direction; an internal case 10 fitted into the external case and opened in the length direction; a circuit board 30 seated in the internal case 10 and emitting an infrared ray by emitting and receiving light; and a pair of caps 40 fitted into both opened surfaces of the internal case 10.

The related art has an advantage that a crime prevention apparatus capable of being cheaply manufactured and having an excellent crime prevention property may be provided.

However, the related art has a problem that power consumption is large to waste power.

In addition, the related art has a problem that it may not applied to a building in which a door, a window, and other important positions are frequently changed depending on a season, and has also a problem that it may not sense all directions by sensing only a specific direction using an infrared ray.

Further, the related art has a problem that a hole should be drilled in a wall of the building in order to install the crime prevention system or the crime prevention system should be installed during a construction period of the building.

DISCLOSURE

Technical Problem

An object of the present invention is to provide a crime prevention system using a sensor module capable of being operated by comparatively low power, being applied to a building in which internal structures and crime prevention environments are various, being installed without remodeling, and sensing all directions.

Technical Solution

In one general aspect, a crime prevention system using a sensor module for sensing inclination in all directions includes: a plurality of sensor modules 1000 installed at areas in which a structure is to be monitored; and a central control unit 2000 transmitting control signals to the plurality of sensor modules 1000 to individually control the plurality of sensor modules 1000 and receiving alarm signals from the plurality of sensor modules 1000 to provide an audible alarm, wherein each of plurality of sensor modules 1000 includes: a module controlling unit 100 controlling components of the sensor module 1000 and processing signals transmitted and received to and from the components of the sensor module 1000; a multi-sensor unit 200 including a body 210 and a plurality of inclination sensors 220 coupled to the body 210 and sensing the inclination in directions; a multi-switch unit 300 including switches closed or opened, respectively, under a control of the module controlling unit 100 and connected to the plurality of inclination sensors 220 by electric wires 310, respectively, and generating the alarm signal and transmitting the generated alarm signal to the module controlling unit 100 when it confirms when the plurality of inclination sensors 220 sense the inclination; and a cutting sensor unit 400 sensing that the electric wires are cut, and generating the alarm signal and transmitting the generated alarm signal to the module controlling unit 100 when it senses that the electric wires 310 are cut.

The plurality of inclination sensors 220 may formed of any one of a conductive liquid inclination switch, a ball switch, a mercury switch, a multi-pole switch, and a multi-pole electrolyte switch, an inner portion of each thereof being in a short-circuit (ON) state or a disconnection (OFF) state.

At least one of the plurality of inclination sensors 220 may be changed from the short-circuit (ON) state to the disconnection (OFF) state or from the disconnection (OFF) state to the short-circuit (ON) state when it has impact applied from the outside thereto.

The multi-switch unit 300 may individually input an initial short-circuit (ON) state or an initial disconnection (OFF) state of each of the plurality of inclination sensors 220, and may generate the alarm signal and transmit the generated alarm signal to the module controlling unit 100 when a state of at least one of the plurality of inclination sensors is changed due to impact from the outside.

The sensor module 1000 may further include: a command input unit 500 connected to the module controlling unit 100 to receive control commands for the components of the sensor module 1000; a first audible alarm unit 600 connected to the module controlling unit 100 to receive the alarm signal from the module controlling unit 100 and generate an alarm lamp and an alarm sound; a timer unit 700 connected to the module controlling unit 100 to set the sensor module 1000 to be operated from a determined time; and a password unit 800 connected to the first audible alarm unit 600 to set a password in the first audible alarm unit 600 and stop an operation of the first audible alarm unit 600 when the set password is input.

The command input unit 500 may receive an operation command, a stop command, and a release command for the sensor module 1000.

The sensor module 1000 may further include a module communication unit 900 receiving the control signal from the central control unit 2000, transmitting the received control signal to the module controlling unit 100, receiving the alarm signal from the module controlling unit 100, and transmitting the received alarm signal to the central control unit 2000.

The central control unit 2000 may include: an interface 2100 receiving control commands and information; a general controlling unit 2200 controlling components of the central control unit 2000, processing signals transmitted and received to and from the components of the central control unit 2000, storing the information input to the interface 2100, and receiving the control commands from the interface 2100 and converting the received control commands into control signals; an internal communication unit 2300 receiving the alarm signals from the plurality of sensor modules 1000, transmitting the received alarm signals to the general controlling unit 2200, receiving the control signals from the general controlling unit 2200, and transmitting the received control signals to the module communication unit 900; an external communication unit 2400 receiving the alarm signals from the general controlling unit 2200 and transmitting the received alarm signals to an external communication network; a second audible alarm unit 2500 generating an alarm lamp and an alarm sound when it receives the alarm signals from the general controlling unit 2200; an image recording unit 2600 storing an alarm situation as a photograph or a moving picture when it receives the alarm signals from the general controlling unit 2200; and an alarm forwarding unit 2700 forwarding alarm fact through using a text message or an e-mail when it receives the alarm signals from the general controlling unit 2200.

The interface 2100 receives individual operation start commands, operation stop commands, and operation end commands of the plurality of sensor modules 1000 and operation start commands, operation stop commands, and operation end commands for the second audible alarm unit, the image recording unit, and the alarm forwarding unit and receives information on a phone number, an e-mail address, and a homepage address.

In another general aspect, a crime prevention method by the crime prevention system 10000 using a sensor module as described above includes: an installing step S01 of installing the sensor module 1000 and the central control unit 200 in a structure; a setting step S02 of confirming and inputting, by the multi-switch unit 300, a short-circuit (ON) or a disconnection (OFF) state of the plurality of the inclination sensors 220 under a control of the module controlling unit 100; a sensing step S03 of sensing, by the multi-sensor unit 200, inclination in at least any one of all directions or sensing, by the cutting sensor unit 400, that the electric wires 310 are cut; an alarm signal generating step S04 of generating, by the multi-switch unit 300, the alarm signal in the case in which the multi-sensor unit 200 recognizes the inclination or generating, by the cutting sensor unit 400 that the electric wires 310 are cut, the alarm signal; an alarm signal transmitting step S05 of sequentially transmitting the alarm signal to the module controlling unit 100, the module communication unit 900, the internal communication unit 2300, and the general controlling unit 2200; an alarm preparing step S06 of transmitting the transmitted alarm signal to the external communication unit 2400, the second audible alarm unit 2500, the image recording unit 2600, and the alarm forwarding unit 2700; and an alarming step S07 of transmitting the alarm signal to the external communication network, generating the alarm lamp and the alarm sound, storing the alarm situation as the photograph or the moving picture, and forwarding the alarm fact through using the text message or the e-mail.

Advantageous Effects

Therefore, a crime prevention system using a sensor module according to an exemplary embodiment of the present invention includes a sensor modules configured to sense directions regardless of installation positions, directions, and angles, such that it may be applied to buildings in which internal structures and crime prevention environments are various.

In addition, a crime prevention system using a sensor module according to an exemplary embodiment of the present invention includes a sensor modules configured to sense directions regardless of installation positions, directions, and angles, such that it may be applied to buildings in which opened and closed states of doors and windows are various depending on a season.

Further, a sensor module having low power consumption is configured, such that power consumption may be relatively low.

Further, a crime prevention system using a sensor module according to an exemplary embodiment of the present invention, which is installed at an outer side of a building, may be simply installed at the building.

BEST MODE

Hereinafter, the spirit of the present invention will be described in more detail with reference to the accompanying drawings.

Figure 1:
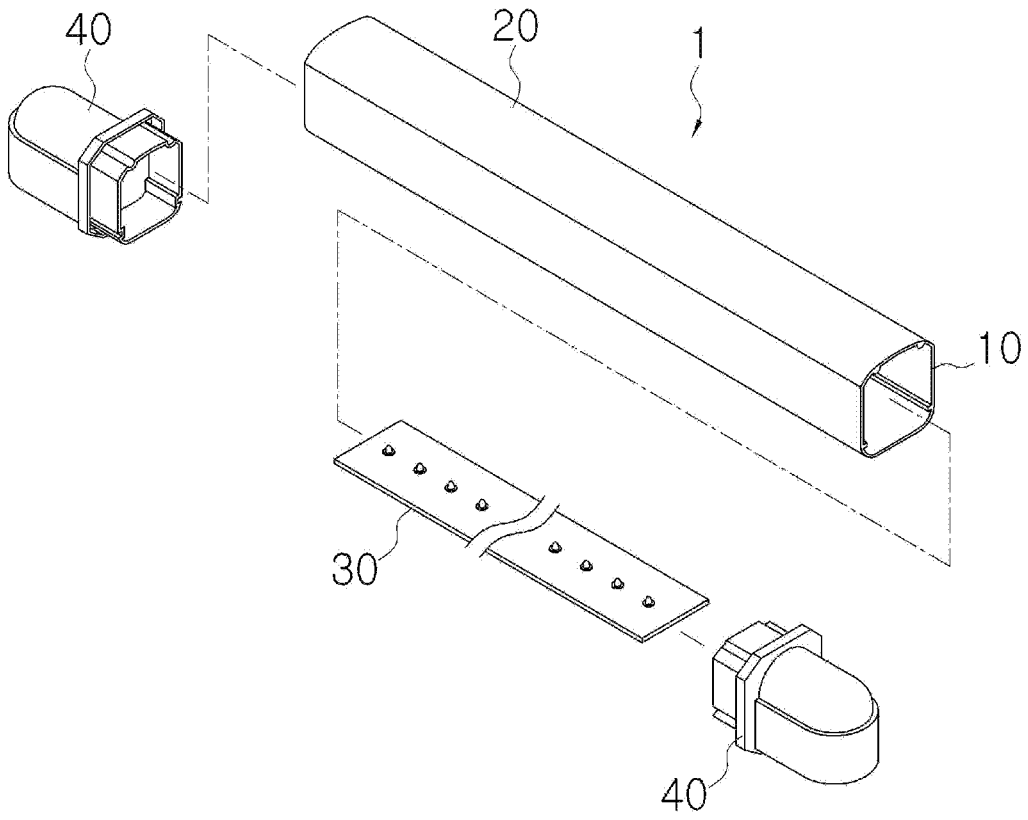
FIG. 1 Prior Art
FIG. 1 is an exploded perspective view of an infrared sensor according to the related art.
Figure 2:
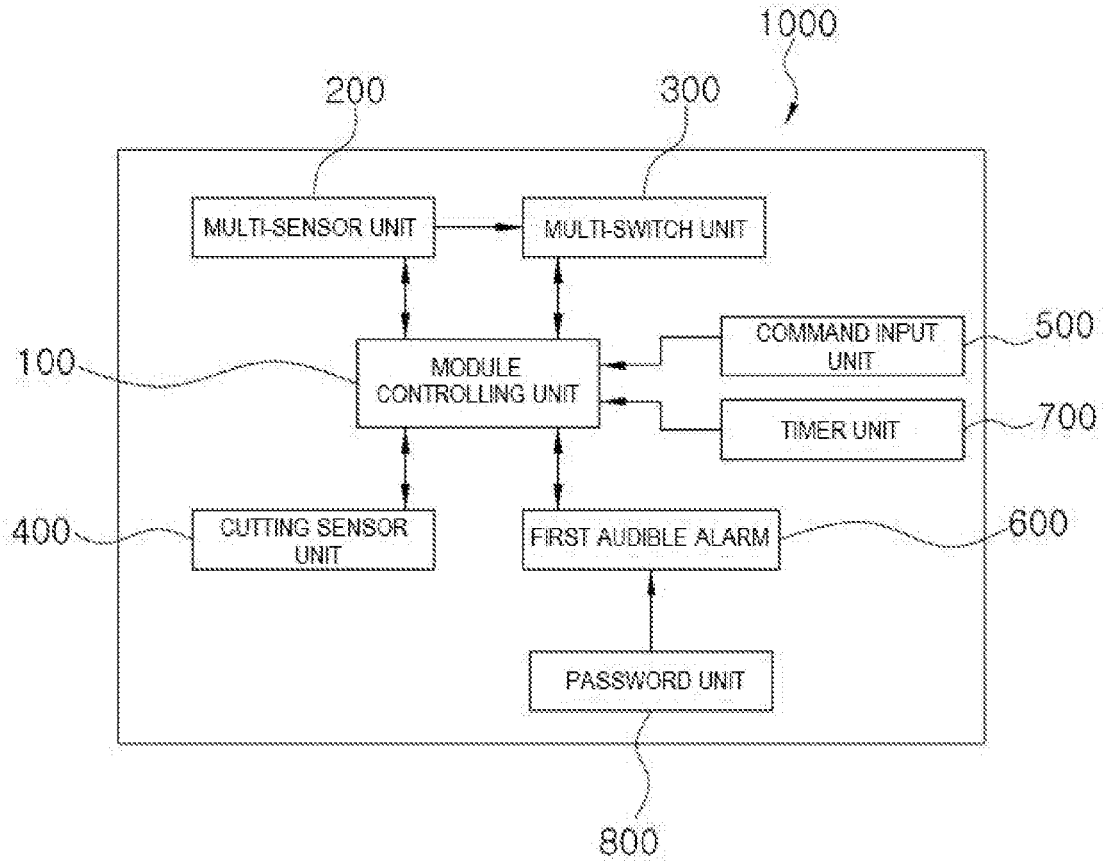
FIG. 2 is a block diagram of a sensor module according to an exemplary embodiment of the present invention.

FIG. 2 is a block diagram of a sensor module according to an exemplary embodiment of the present invention.

As shown in FIG. 2, a sensor module 1000 according to an exemplary embodiment of the present invention sensing inclination in all directions viewed from a central point of a sphere toward an outer surface of the sphere is configured to include a module controlling unit 100, a multi-sensor unit 200, a multi-switch unit 300, and a cutting sensor unit 400. Hereinafter, each unit will be described in more detail.

The module controlling unit 100 controls components of the sensor module 1000 and processes signals transmitted and received to and from the components of the sensor module 1000.

Figure 3:
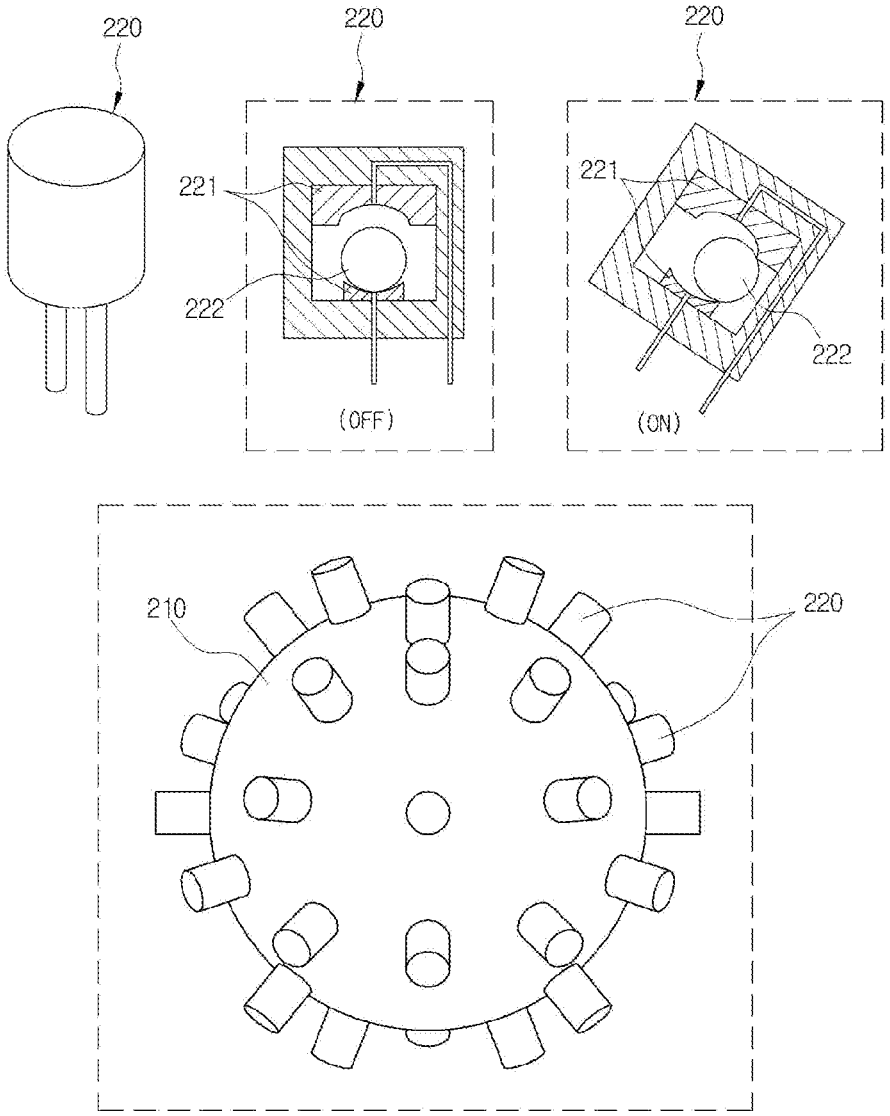
FIG. 3 is an exploded perspective view of a multi-sensor unit according to an exemplary embodiment of the present invention.

FIG. 3 is an exploded perspective view of a multi-sensor unit according to an exemplary embodiment of the present invention.

As shown in FIG. 3, the multi-sensor unit 200 includes a body 210 formed in a spherical shape, a cylindrical shape, or an eggplant shape, and a plurality of inclination sensors 220 coupled to the body 210 and sensing inclination in all directions viewed from a central point of the body 210 toward an outer surface thereof.

The body 210 of the multi-sensor unit 200 is preferably formed in the spherical shape, the cylindrical shape, or the eggplant shape, but is not limited thereto. That is, the body 210 of the multi-sensor unit 200 may be formed in various shapes.

The plurality of inclination sensors 220 may be formed of any one of a conductive liquid inclination switch, a ball switch, a mercury switch, a multi-pole switch, and a multi-pole electrolyte switch, an inner portion of each thereof being in a short-circuit (ON) state or a disconnection (OFF) state.

In addition, FIG. 3 shows the case in which the plurality of inclination sensors 220 are formed of the multi-pole ball switch.

As shown in FIG. 3, in the case in which each of the plurality of inclination sensors 220 are formed of the multi-pole ball switch, each of the plurality of inclination sensors 220 may include a pair of separated conductors 221 attached to both ends of an inner surface thereof, respectively, and a conductor ball 222 freely rolled therein.

The pair of separated conductors 221 attached to both ends of the inner surface of each of the plurality of inclination sensors 220, respectively, and the conductor ball 222 may be in the short-circuit (ON) state or the disconnection (OFF) state depending on positions and directions at and in which they are installed.

Here, the short-circuit (ON) state means a state in which two conductors are electrically connected to each other, and the disconnection (OFF) state means a state in which the two conductors are not electrically connected to each other.

The multi-switch unit 300 is connected to each of the plurality of inclination sensors 220 by electric wires 310.

Here, the multi-switch unit 300 is controlled by the module controlling unit 100, such that some of switches thereof are closed and the other thereof are opened.

Therefore, only some of the plurality of inclination sensors 220 connected to the closed switches in the multi-switch unit 300 are operated.

In addition, the multi-switch unit 300 individually inputs an initial short-circuit (ON) state or an initial disconnection (OFF) state of each of the plurality of inclination sensors 220 connected to the closed switches by the electric wires 310, and generates an alarm signal and transmits the generated alarm signal to the module controlling unit 100 when a state of at least one of the plurality of inclination sensors 220 is changed due to impact from the outside.

Figure 4:
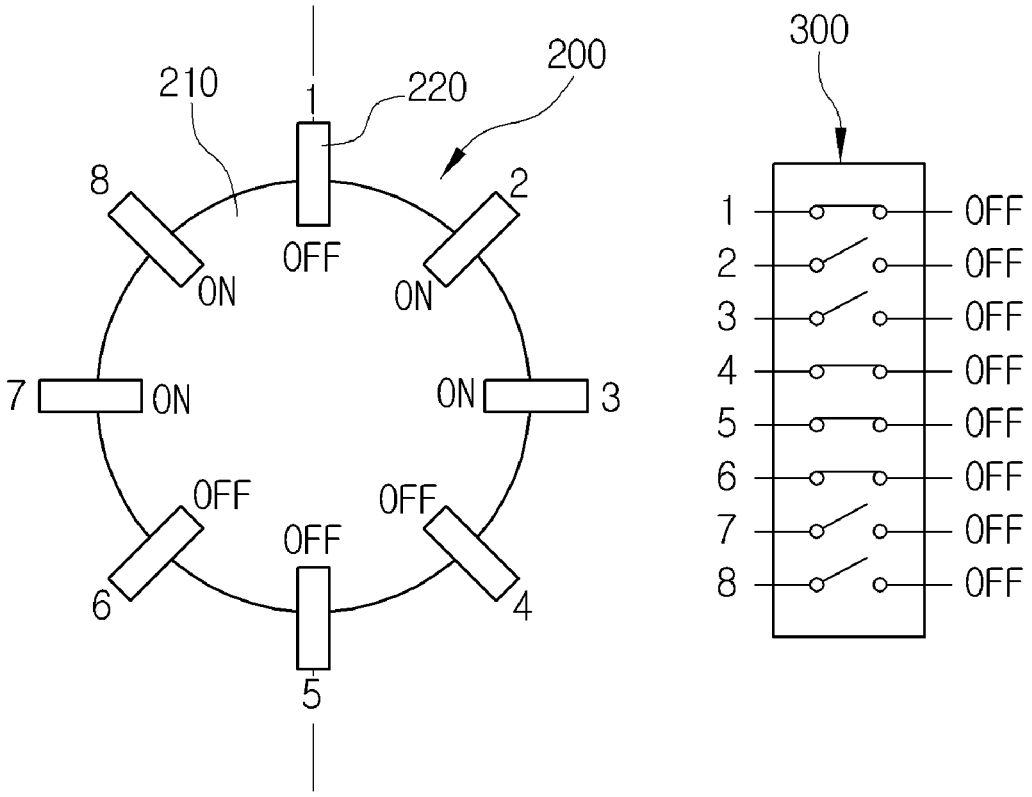
FIGS. 4 and 5 are diagrams showing an operation sequence of the multi-sensor unit and a multi-switch unit according to an exemplary embodiment of the present invention.
Figure 5:
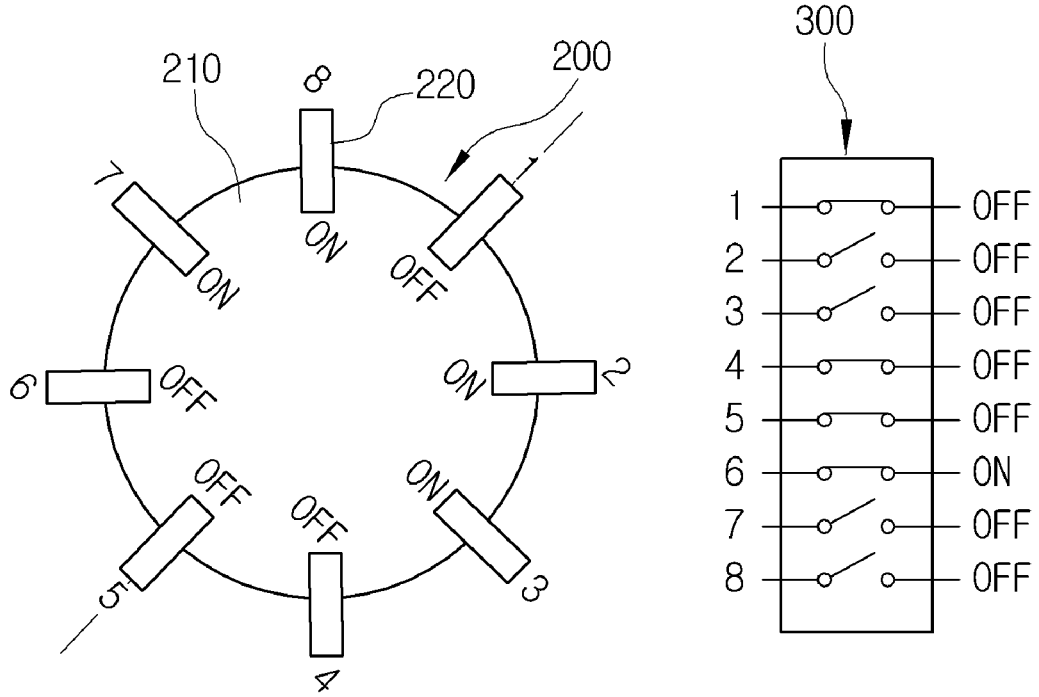

FIGS. 4 and 5 are diagrams showing an operation sequence of the multi-sensor unit and a multi-switch unit according to an exemplary embodiment of the present invention.

An operation sequence of the multi-switch unit 300 will be described in more detail with reference to FIGS. 4 and 5.

Referring to numbers represented in FIG. 4, the pair of separated conductors 221 and the conductor ball 222 included in the plurality of inclination sensors 220 corresponding to Nos. 1, 4, 5, and 6 are in the disconnection (OFF) state, and the pair of separated conductors 221 and the conductor ball 222 included in the plurality of inclination sensors 220 corresponding to Nos. 2, 3, 7, and 8 are in the short-circuit (ON) state.

Next, the multi-sensor unit 200 receives a command from the module controlling unit 100 to close switches corresponding to Nos. 1, 4, 5, and 6 and operates inclination sensors corresponding to Nos. 1, 4, 5, and 6.

Next, referring to numbers represented in FIG. 5, when the plurality of inclination sensors 220 are inclined due to the impact from the outside, an inclination sensor corresponding to No. 6 is changed from the disconnection (OFF) state to a short-circuit (ON) state.

In this case, the multi-switch unit 300 generates the alarm signal and transmits the generated alarm signal to the module controlling unit 100.

In addition, the cutting sensor unit 400 individually senses that the electric wires 310 connecting the plurality of inclination sensors and the multi-switch unit 300 to each other are cut, and generates an alarm signal and transmits the generated alarm signal to the module controlling unit 100 when it senses that the electric wires 310 are cut.

Figure 6:
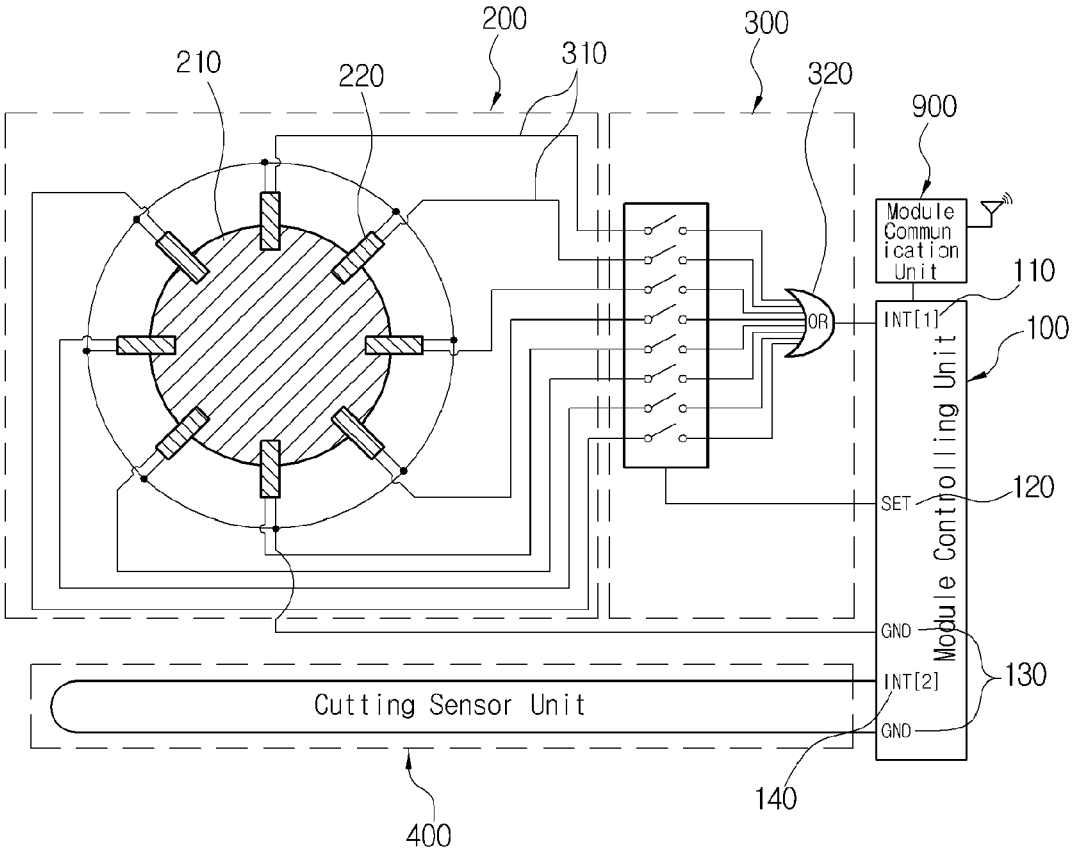
FIG. 6 is a logical circuit configuration diagram of a sensor module according to an exemplary embodiment of the present invention.

FIG. 6 is a logical circuit configuration diagram of a sensor module according to an exemplary embodiment of the present invention.

As shown in FIG. 6, the sensor module 1000 includes a logical circuit configured therein. This will be described in more detail.

The module controlling unit 100 is characterized in that it further includes a first interrupt port 110 receiving an alarm signal from the multi-switch unit 300; a setting port 120 individually setting opening and closing of the multi-switch unit 300; a plurality of ground ports 130 grounded to the components of the sensor module 1000; and a second interrupt port 140 receiving an alarm signal from the cutting sensor unit 400.

In addition, the multi-switch unit 300 is characterized in that it further includes a logical sum gate 320 inputting initial states (short-circuit (ON) states or disconnection (OFF) states) of the plurality of inclination sensors 220.

Therefore, the logical sum gate 320 generates an alarm signal and transmits the generated alarm signal to the first interrupt port 110 when at least one of the pair of separated conductors 221 and the conductor ball 222 included in the plurality of inclination sensors 220 is changed from the short-state (ON) state to the disconnection (OFF) state or is changed from the disconnection (OFF) state to the short-circuit (ON) state due to the impact from the outside.

Therefore, the sensor module 1000 according to an exemplary embodiment of the present invention senses that an invader cuts the electric wire connected to the module for invasion in advance and transmits the alarm signal, thereby making it possible to efficiently prepare for the invasion of the invader.

The sensor module 1000 is characterized in that it further includes a command input unit 500, a first audible alarm unit 600, a timer unit 700, and a password unit 800. Hereinafter, each unit will be described in more detail.

The command input unit 500 is connected to the module controlling unit 100 to receive an operation command, a stop command, and a release command for the sensor module 1000.

That is, the sensor module 1000 may start an operation thereof, stop the operation thereof, or release the operation thereby by receiving commands from the command input unit 500.

In addition, the first audible alarm unit 600 includes an alarm lamp and a device generating an alarm sound, and is connected to the module controlling unit 100 to receive an alarm signal from the module controlling unit 100 and generate an alarm lamp and an alarm sound.

Further, the timer unit 700 is connected to the module controlling unit 100 to set the sensor module 1000 receiving the operation command from the common input unit 500 to be operated from a determined time or be stopped or released at a determined time.

Further, the password unit 800 is connected to the first audible alarm unit 600 to set a password in the first audible alarm unit 600 and stop an operation of the first audible alarm unit 600 when the set password is input.

That is, when the first audible alarm unit 600 receives the alarm signal to generate the alarm lamp and the alarm sound, the password unit 800 may receive a preset password to stop the operation of the first audible alarm unit 600.

Therefore, the sensor module 1000 according to an exemplary embodiment of the present disclosure may have relatively small power consumption.

Figure 7:
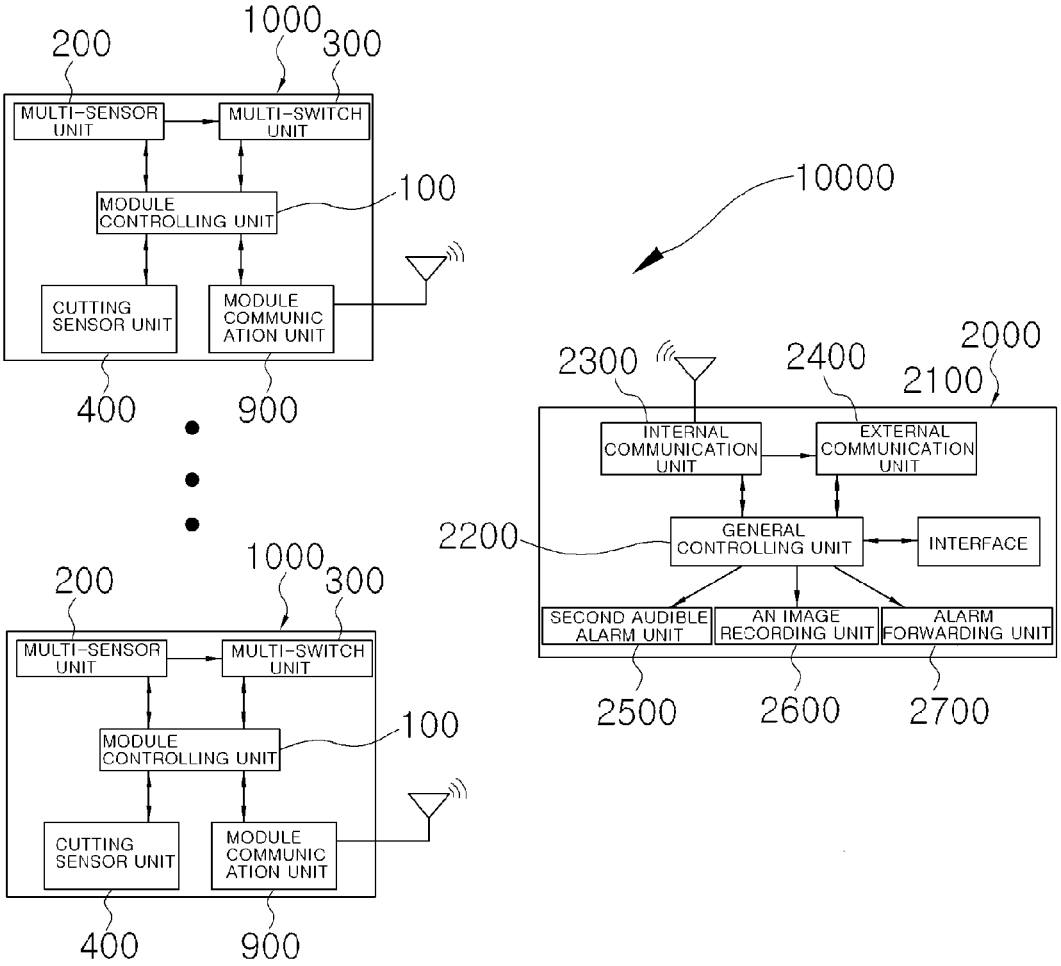
FIG. 7 is a block diagram of a crime prevention system using a sensor module according to an exemplary embodiment of the present invention.

FIG. 7 is a block diagram of a crime prevention system using a sensor module according to an exemplary embodiment of the present invention.

As shown in FIG. 7, a crime prevention system 10000 using a sensor module according to an exemplary embodiment of the present invention is characterized in that it includes a plurality of sensor modules 1000 and a central control unit 2000.

In more detail, in the crime prevention system 10000 using a sensor module according to an exemplary embodiment of the present invention, a plurality of sensor modules 1000 are installed in areas in which a structure needs to be monitored and sense inclination of directions regardless of installation positions, directions, and angles.

In addition, the sensor module 1000 of the crime prevention system 10000 using a sensor module according to an exemplary embodiment of the present invention is characterized in that it further includes a module communication unit 900 connected to the central control unit 2000 by wired or wireless communication.

Here, the module communication unit 900 receives a control signal from the central control unit 2000, transmits the received control signal to the module controlling unit 100, receives the alarm signal from the module controlling unit, and transmits the received alarm signal to the central control unit 2000.

In addition, the central control unit 2000 is characterized in that it includes an interface 2100, a general controlling unit 2200, an internal communication unit 2300, an external communication unit 2400, a second audible alarm unit 2500, an image recording unit 2600, and an alarm forwarding unit 2700. Hereinafter, each unit will be described in more detail.

The interface 2100 receives control commands from a user, converts the received input control commands into control signals, transmits the control signal to the general controlling unit 2200, receives information of the user, and transmits the information to the general controlling unit 2200.

Here, the interface 2100 individually controls the plurality of sensor modules 1000 connected to the central control unit 2000 by the wired or wireless communication depending on the control commands from the user.

In addition, the interface 2100 is characterized in that it receives an operation start command operating the sensor module 1000, an operation stop command stopping the operation of the sensor module 1000, and an operation end command ending the operation of the sensor module 1000.

In addition, the interface 2100 receives operation start commands, operation stop commands, and operation end commands for the second audible alarm unit 2500, the image recording unit 2600, and the alarm forwarding unit 2700 from the user, receives a phone number, an e-mail address, and a homepage address of the user, and transmits them to the general controlling unit 2200.

In addition, the general controlling unit 2200 receives and stores information of the user from the interface 2100.

In addition, the general controlling unit 2200 receives control commands for the interface 2100, the internal communication unit 2300, the external communication unit 2400, the second audible alarm unit 2500, the image recording unit 2600, and the alarm forwarding unit 2700 from the interface 2100, converts the received control commands into control signals, and then transmits the control signals to the interface 2100, the internal communication unit 2300, the external communication unit 2400, the second audible alarm unit 2500, the image recording unit 2600, and the alarm forwarding unit 2700.

Further, the general controlling unit 2200 receives control commands for the plurality of sensor modules 1000 from the interface 2100, converts the received control commands into control signals, and transmits the control signals to the internal communication unit 2300.

The internal communication unit 2300 is connected to the plurality of sensor modules 1000 by the wired or wireless communication and transmits and receives the alarm signals and the control signals.

In addition, the internal communication unit 2300 receives the control signals from the general controlling unit 2200, transmits the received control signals to the plurality of sensor modules 1000, receives the alarm signals from the plurality of sensor modules 1000, and transmits the received alarm signals to the general controlling unit 2200.

In addition, the external communication unit 2400 receives the alarm signals from the general controlling unit 2200 and transmits the received alarm signals to an external communication network. Here, the external communication network means the Internet network.

In addition, the second audible alarm unit 2500 generates an alarm lamp and an alarm sound when it receives the alarm signals from the general controlling unit 2200.

Further, the image recording unit 2600 stores an alarm situation as a photograph or a moving picture when it receives the alarm signals from the general controlling unit 2200.

In addition, the alarm forwarding unit 2700 forwards alarm fact through using a text message or an e-mail when it receives the alarm signals from the general controlling unit 2200.

Figure 8:
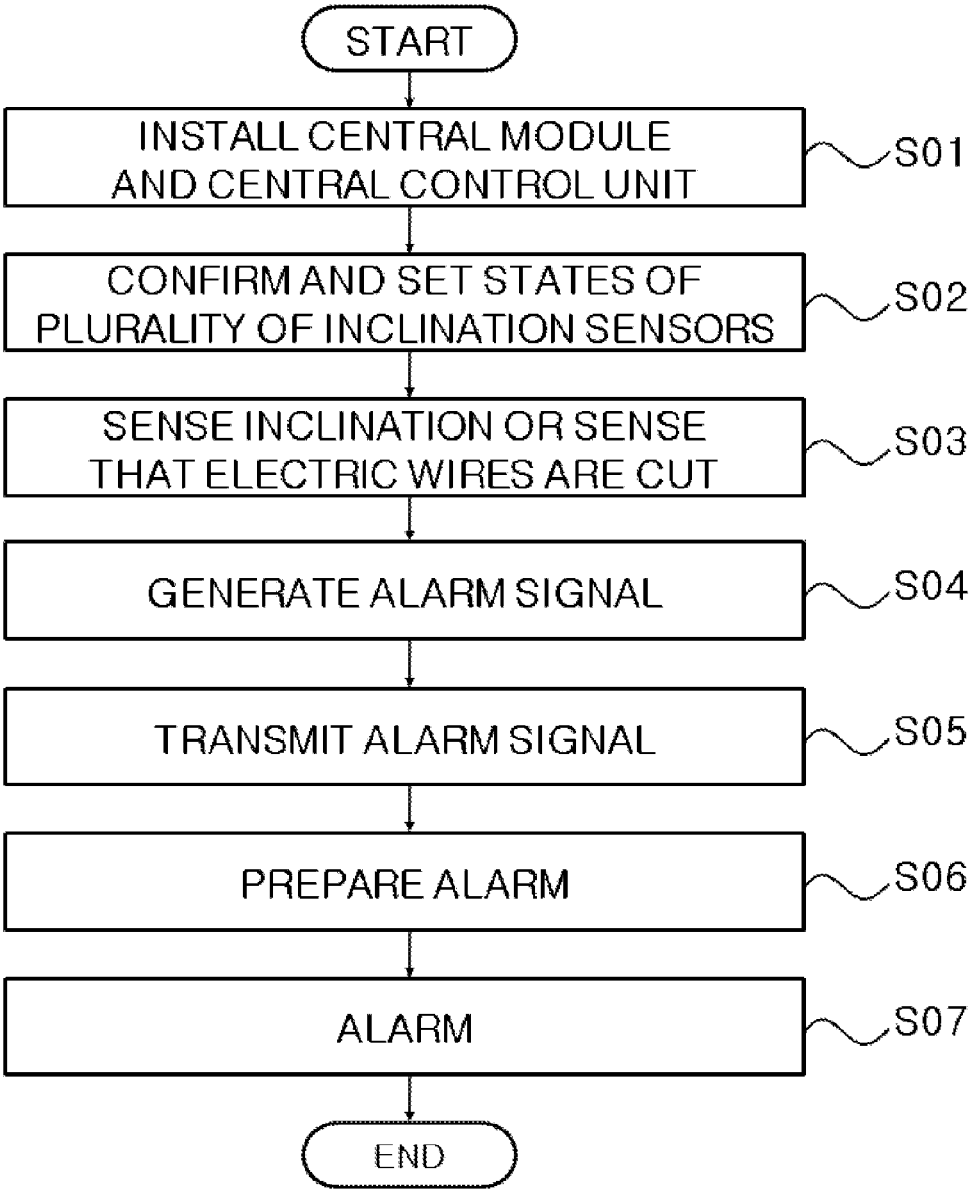
FIG. 8 is a flow chart of a crime prevention method by a crime prevention system using a sensor module according to an exemplary embodiment of the present invention.

FIG. 8 is a flow chart of a crime prevention method by a crime prevention system using a sensor module according to an exemplary embodiment of the present invention.

As shown in FIG. 8, a crime prevention method by a crime prevention system 10000 using a sensor module according to an exemplary embodiment of the present invention includes the following steps.

First, the plurality of sensor modules 1000 are installed at places of a structure that needs to be monitored, and the central control unit 2000 is installed in the structure. This corresponds to operation step S01 shown in FIG. 8.

Next, the module controlling unit 100 is controlled to close all of the switches of the multi-switch unit 300. In addition, the module controlling unit 100 confirms the plurality of inclination sensors 220 that are in the short-circuit (ON) state among the plurality of inclination sensors 220. Further, the module controlling unit 100 controls the multi-switch unit 300 to open the switches connected to the plurality of inclination sensors 220 that are in the short-circuit (ON) state. That is, when the plurality of inclination sensors 220 are in the short-circuit (ON) state, the corresponding switches of the multi-switch unit 300 are opened, and when plurality of inclination sensors 220 that are in the disconnection (OFF) state, the corresponding switches of the multi-switch unit 300 are maintained in the closed state. This corresponds to operation step (S02) shown in FIG. 8.

Next, the multi-sensor unit 200 senses inclination in at least any one of directions through the plurality of inclination sensors 220 included therein or the cutting sensor unit 400 senses that the electric wire 310 is cut. This corresponds to operation step (S03) shown in FIG. 8.

Next, the multi-switch unit 300 senses a change in the short-circuit (ON) state or the disconnection (OFF) state of the pair of separated conductors 221 and the conductor ball 222 included in the plurality of inclination sensors 220 due to the inclinations. In this case, the multi-switch unit 300 generates the alarm signal.

In addition, when the electric wire 310 is cut by the invader, the cutting sensor unit 400 sensing that the electric wire 310 are cut generates the alarm signal. This corresponds to operation step (S04) shown in FIG. 8.

Next, the alarm signal generated by the multi-switch unit 300 or the cutting sensor unit 400 is sequentially transmitted to the module controlling unit 100, the module communication unit 900, the internal communication unit 2300, and the general controlling unit 2200. This corresponds to operation step (S05) shown in FIG. 8.

Next, the alarm signal transmitted from the general controlling unit 2200 is transmitted to each of the external communication unit 2400, the second audible alarm unit 2500, the image recording unit 2600, and the alarm forwarding unit 2700. This corresponds to operation step (S06) shown in FIG. 8.

Finally, the external communication unit 2400 transmits the alarm signal to the external communication network, the second audible alarm unit 2500 generates the alarm lamp and the alarm sound, the image recording unit 2600 stores the alarm situation as the photograph or the moving picture, and the alarm forwarding unit 2700 forwards the alarm fact to the user through the text message and the e-mail using the information of the user input in the general controlling unit in advance. This corresponds to operation step (S07) shown in FIG. 8.

Therefore, the crime prevention system 10000 using a sensor module according to an exemplary embodiment of the present invention includes the sensor modules 1000 configured to sense the directions regardless of the installation positions, directions, and angles, such that it may be applied to buildings in which internal structures and crime prevention environments are various.

In addition, the crime prevention system 10000 using a sensor module according to an exemplary embodiment of the present invention includes the sensor modules 1000 configured to sense the directions regardless of the installation positions, directions, and angles, such that it may be applied to buildings in which opened and closed states of doors and windows are various depending on a season.

Further, the crime prevention system 10000 using a sensor module according to an exemplary embodiment of the present invention, which is installed at an outer side of the building, may be simply installed at the building.

FIGS. 9 to 17 are diagrams showing several examples of the multi-sensor unit according to an exemplary embodiment of the present invention.

Figure 9:
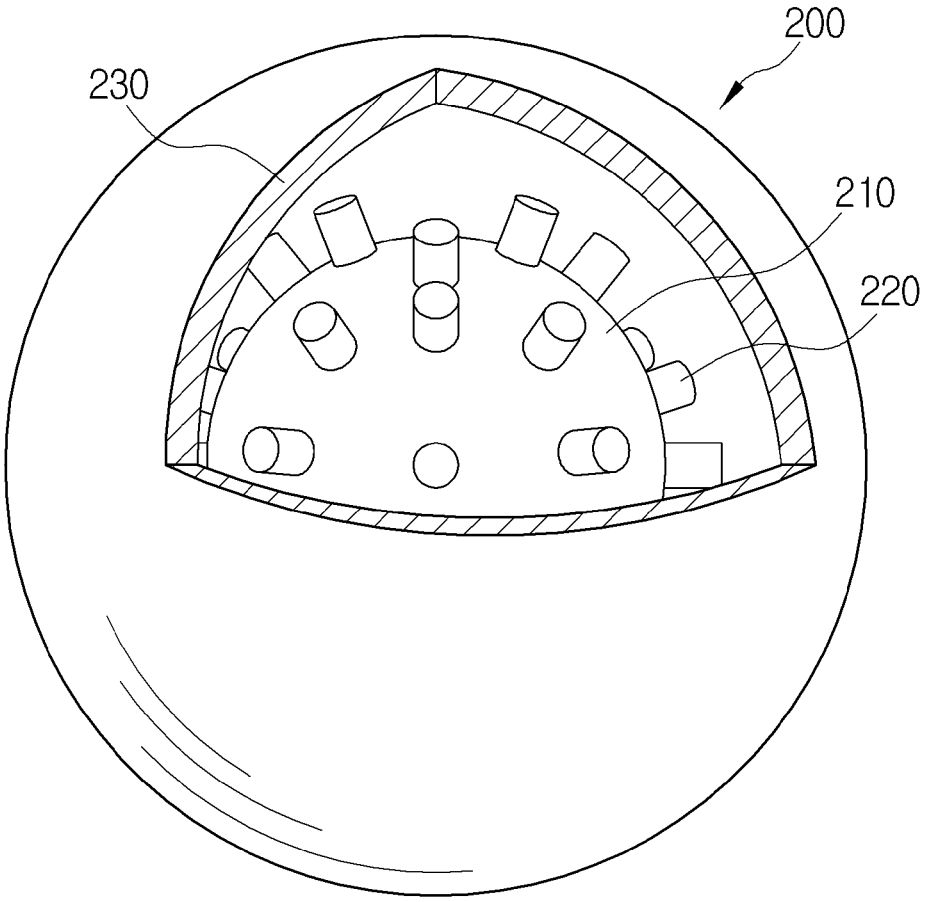
FIGS. 9 to 17 are diagrams showing several examples of the multi-sensor unit according to an exemplary embodiment of the present invention.
Figure 10:
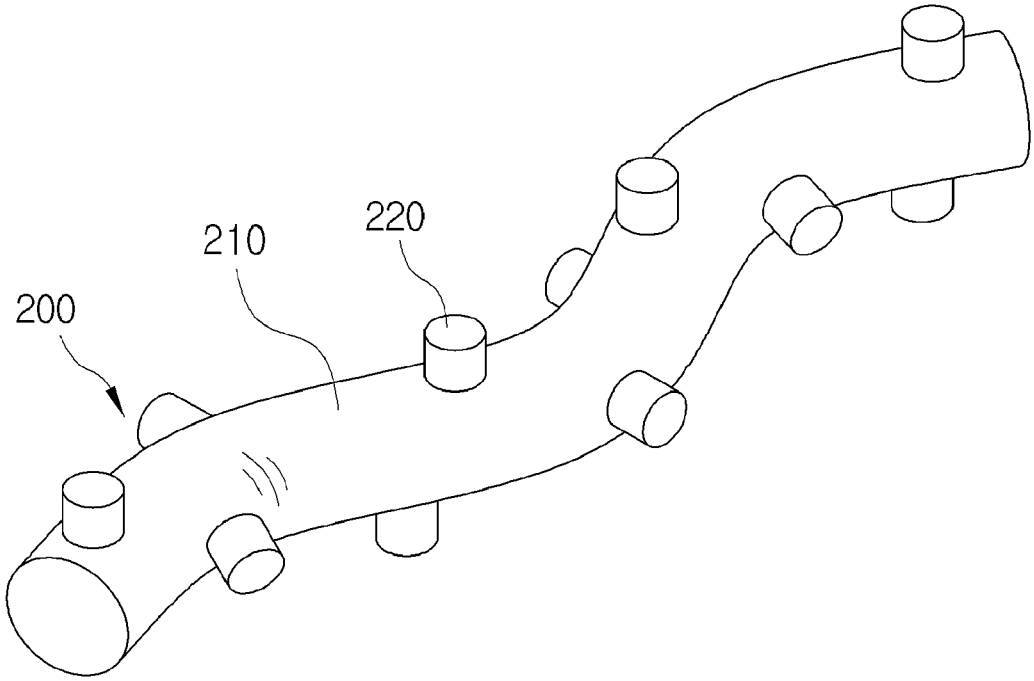

FIG. 9 shows an example in which the multi-sensor unit 200 includes an external case 230, and FIG. 10 shows an example of a form of the body 210 of the multi-sensor unit 200.

As shown in FIG. 9, the multi-sensor unit 200 may be formed in a spherical shape and may further include the external case 230 enclosing the multi-sensor unit 200.

The external case 230 encloses the multi-sensor unit 200 to assist the multi-sensor unit 200 to more rapidly sense the inclination due to the impact from the outside.

As shown in FIG. 10, the body 210 included in the multi-sensor unit 200 may be formed in a cylindrical shape using a smooth material that may be bent.

The body 210 included in the multi-sensor unit 200 is formed in the cylindrical shape using the smooth material that may be bent, such that the multi-sensor unit 200 may be disposed even in a narrow space.

Figure 11:
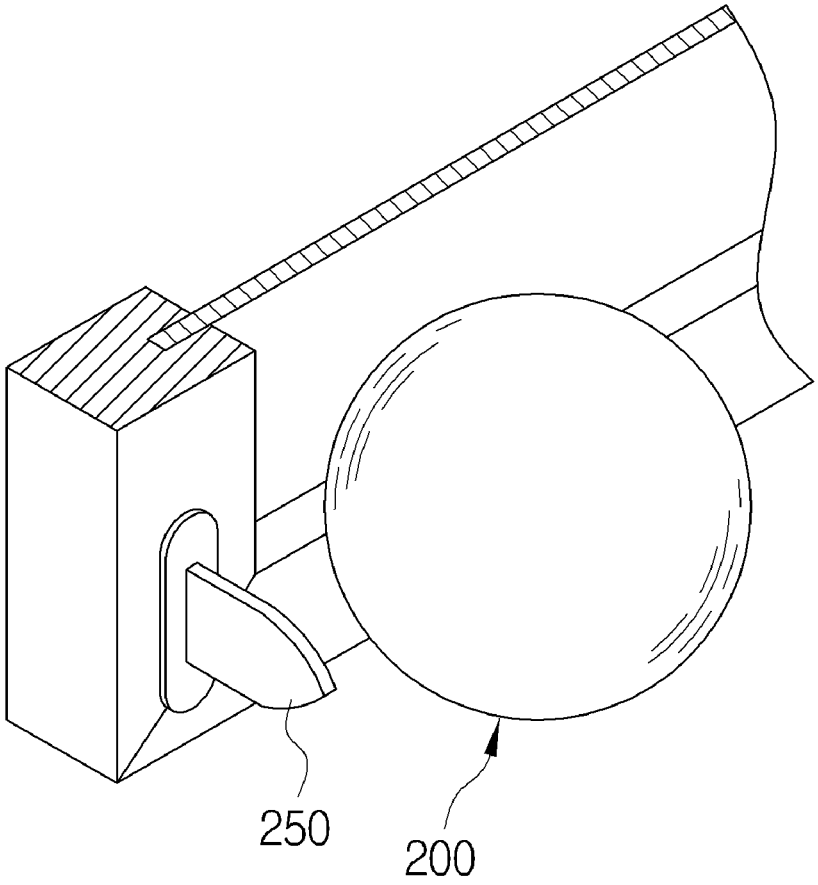
Figure 12:
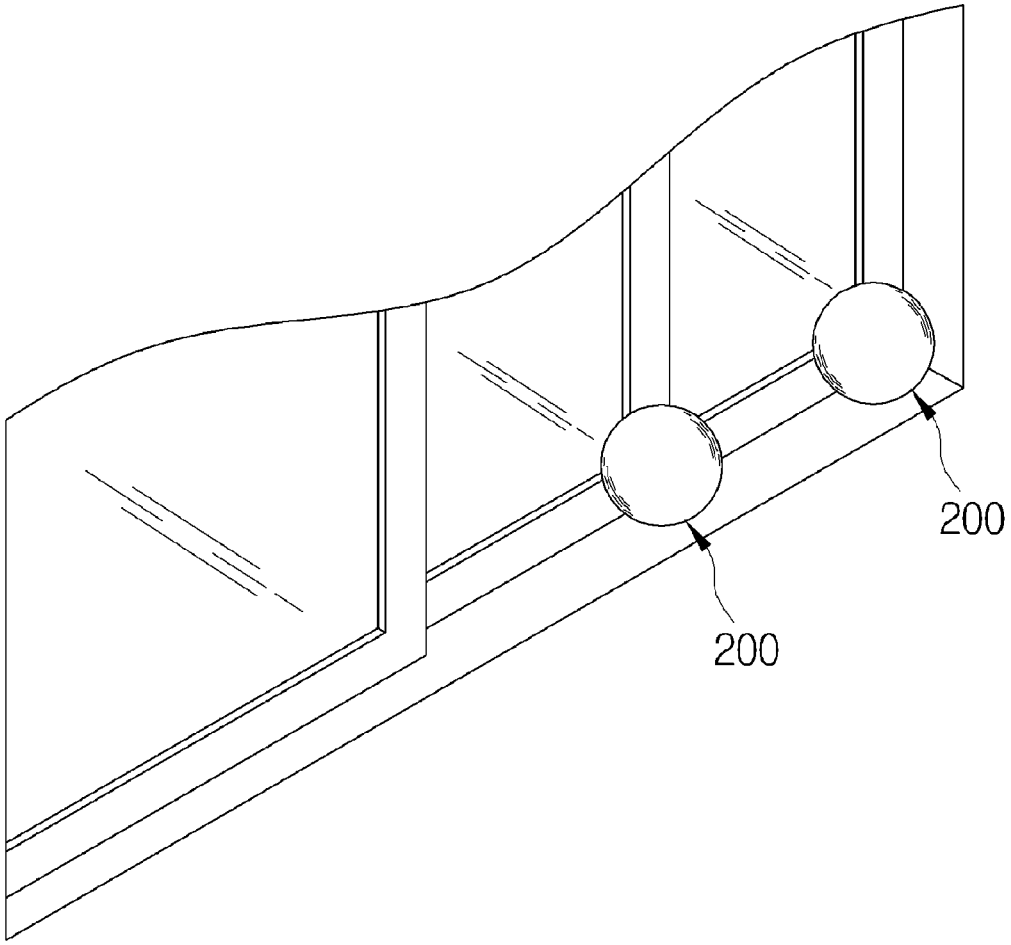

FIG. 11 shows an example in which the multi-sensor unit including the external case senses inclination on a window, and FIG. 12 shows an example in which the multi-sensor unit including the external case is installed on a window.

As shown in FIG. 11, the multi-sensor unit 200 including the external case may further include an auxiliary support 250 attached to a side of a wall spaced apart from the window on which it is installed by a predetermined distance and formed in a bell shape.

The auxiliary stand 250 may assist the multi-sensor unit 200 to more effectively sense the inclination due to movement of the window.

As shown in FIG. 12, the multi-sensor unit 200 including the external case may be more easily installed on the window.

Figure 13:
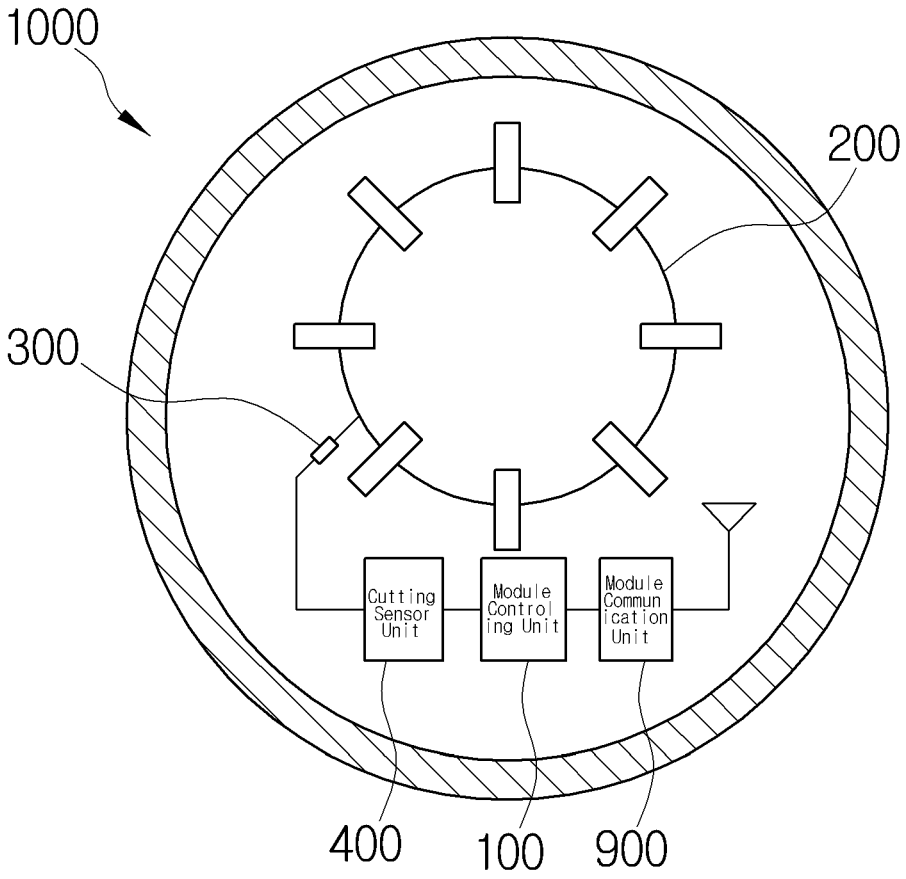
Figure 14:
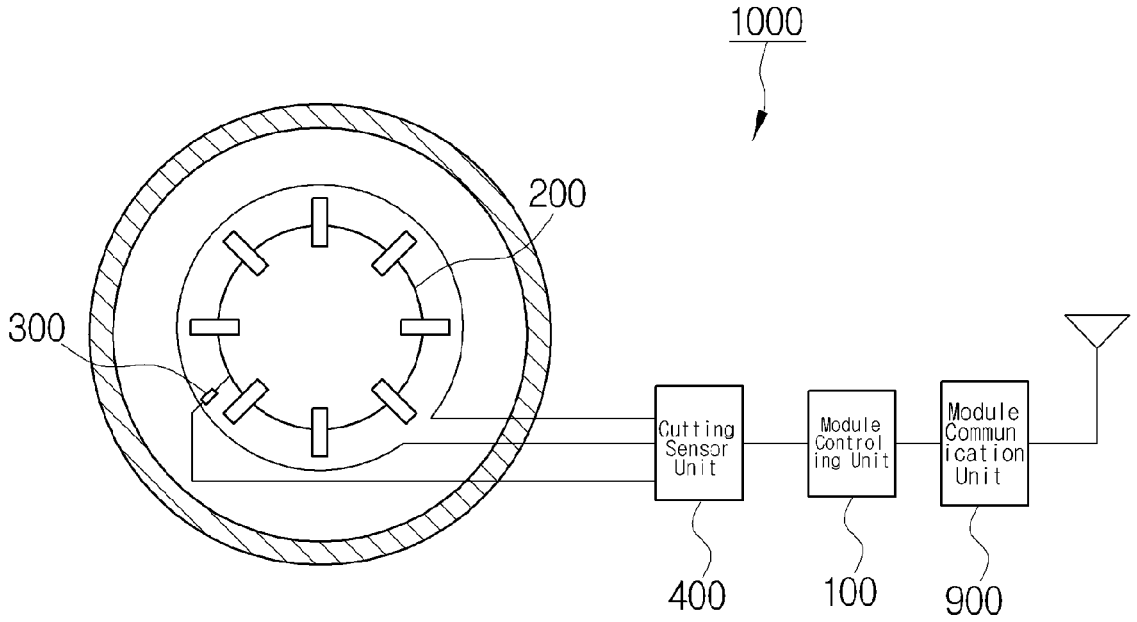

FIGS. 13 and 14 show examples for disposition of components of the sensor module.

As shown in FIGS. 13 and 14, the sensor module 1000 may be formed in an internal mounting form, a form in which the components thereof are mounted at an inner portion thereof, and may be formed in an external mounting form, a form in which the cutting sensor unit 400 is mounted at an outer portion thereof.

Figure 15:
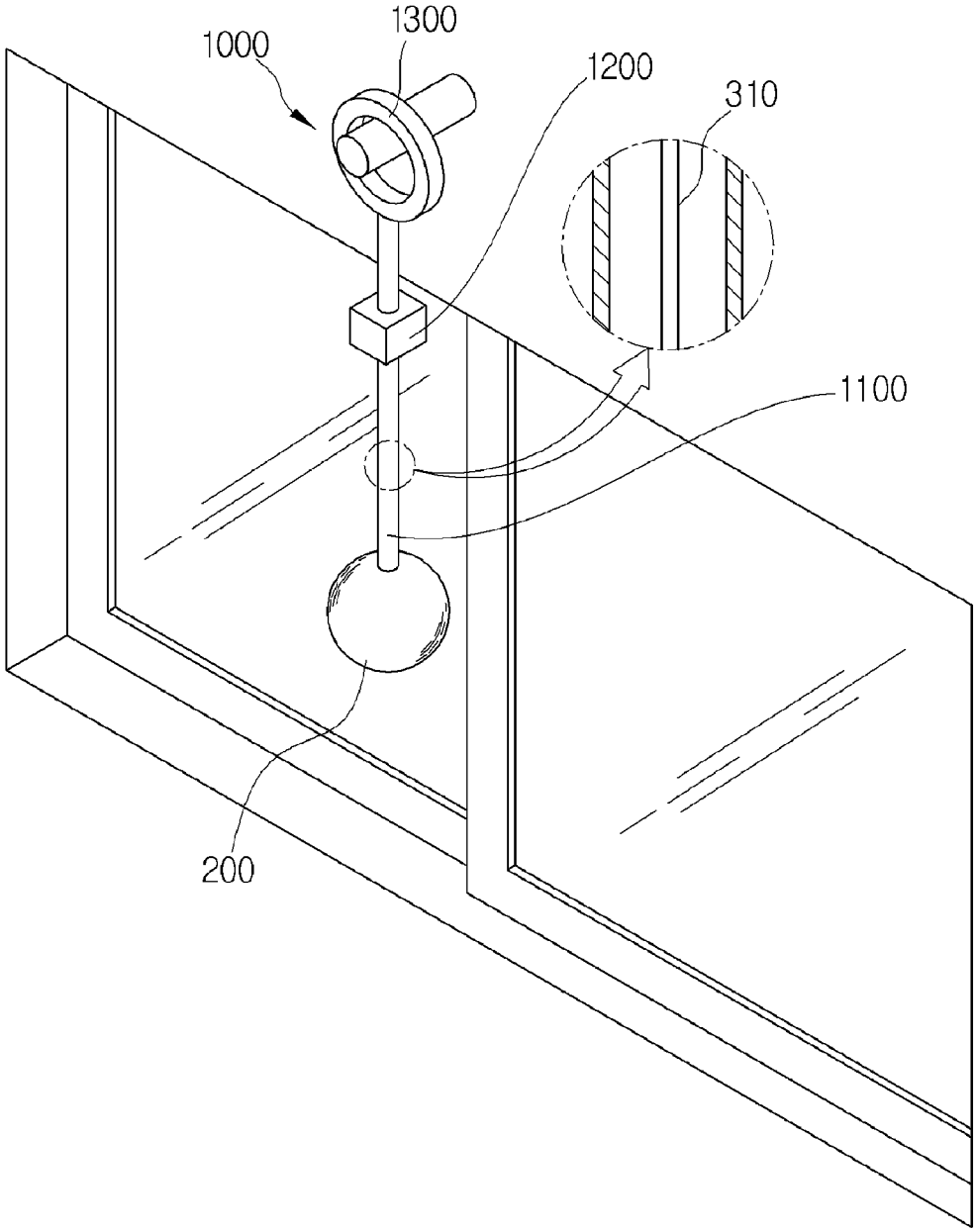

FIG. 15 shows an example for installation of the sensor module formed in an external mounting form.

As shown in FIG. 15, the sensor module 1000 formed in the external mounting form may further include a protecting pipe 1100 enclosing the cutting sensor unit 400 and the electric wire 310; an internal case 1200 formed in a rectangular parallelepiped shape, having one end connected to one end of the protecting pipe 1100, and embedding components except for the multi-sensor unit 200 and the cutting sensor unit 400 therein; and a peg rack part 1300 connected to the other end of the internal case 1200 and formed in a ring shape to thereby being pegged.

Here, the sensor module 1000 formed in the external mounting form may receive commercial power in addition to power of a battery.

Figure 16:
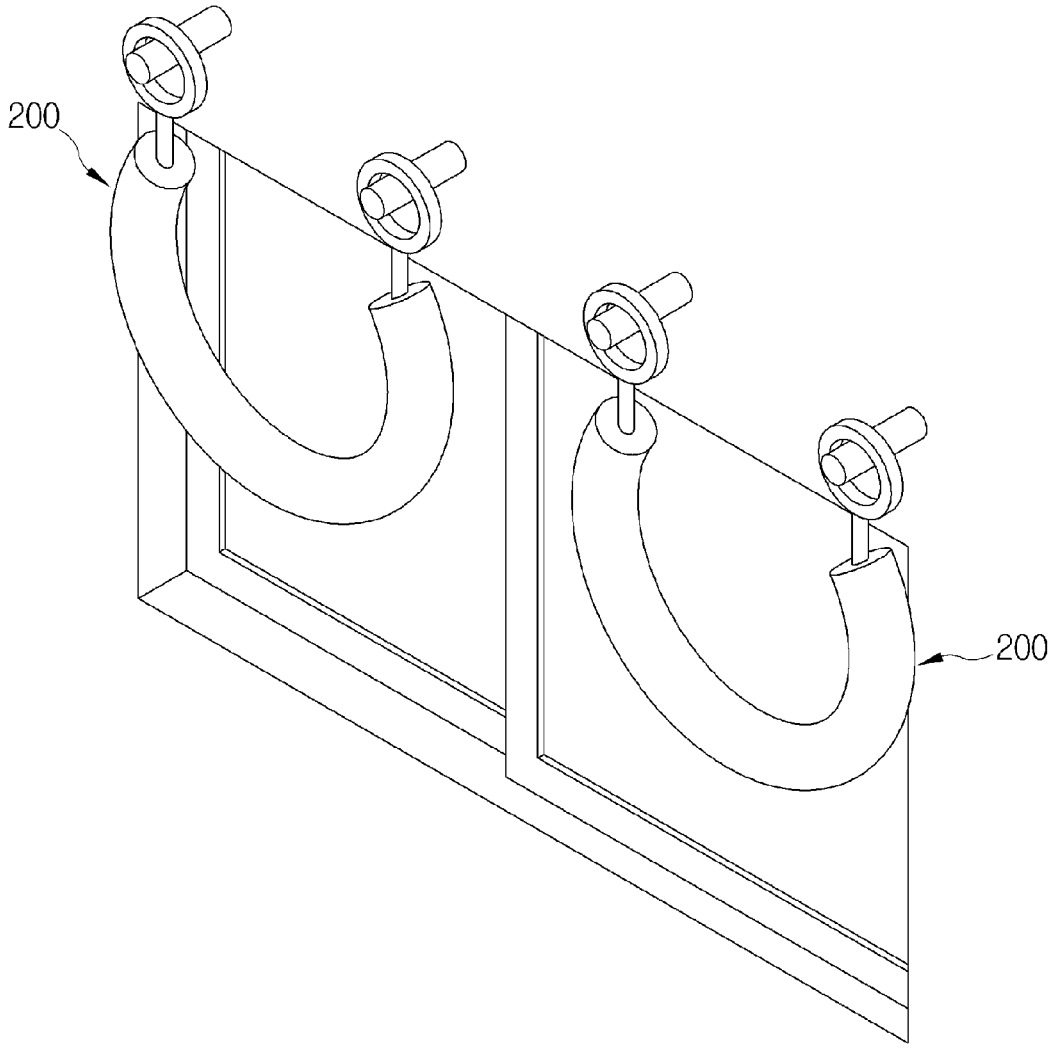

FIG. 16 shows an example in which the multi-sensor unit 200 is installed in an eggplant shape.

As shown in FIG. 16, the multi-sensor unit 200 including the body 210 formed in the eggplant shape has a pair of rings coupled to both ends thereof, respectively, to thereby be hung, such that it may sense invasion even in a state in which the window is opened. Therefore, the multi-sensor unit 200 including the body 210 formed in the eggplant shape may be effectively used in the summer in which the window is frequently opened.

Figure 17:
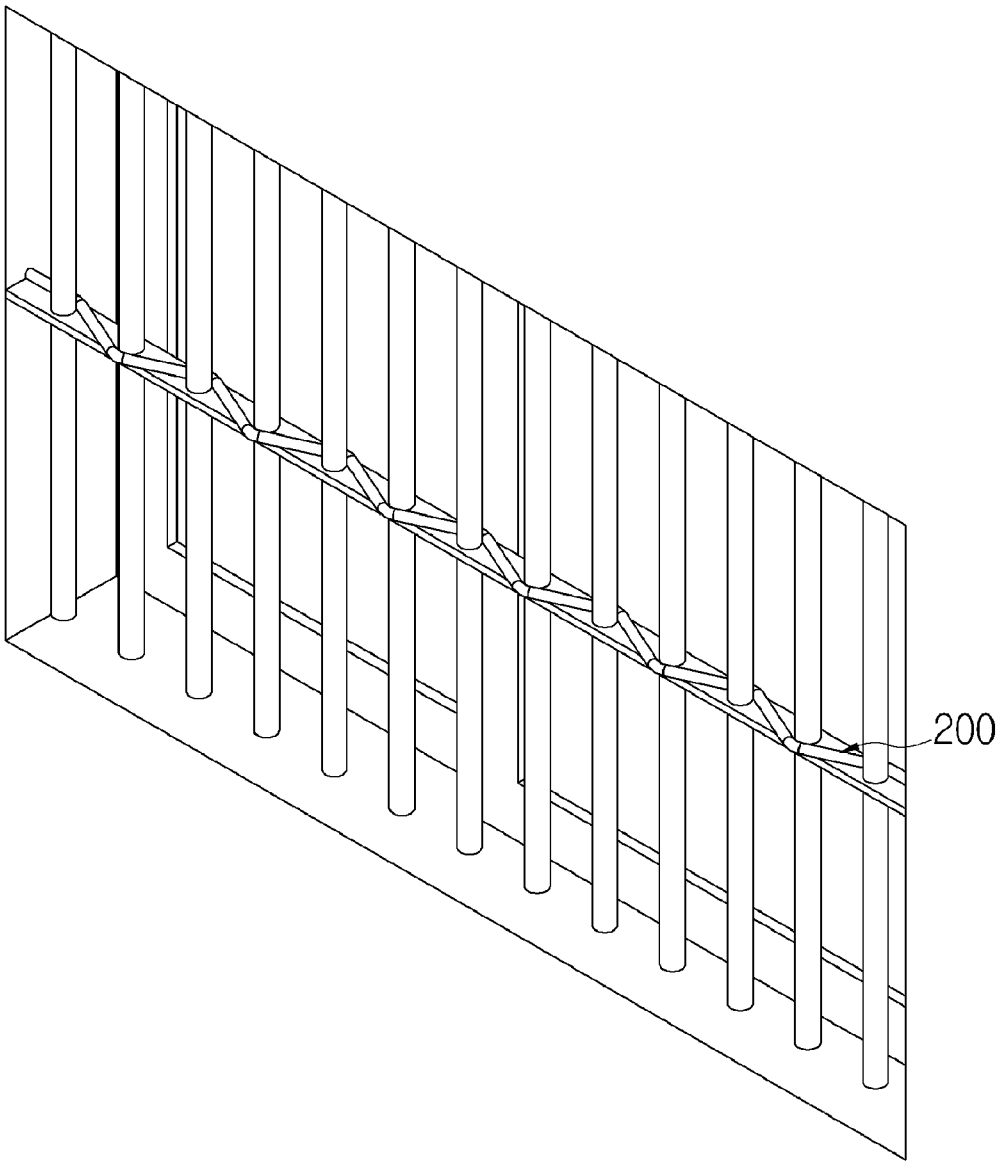

FIG. 17 shows another example in which the multi-sensor unit is formed in an eggplant shape.

As shown in FIG. 17, multi-sensor unit 200 including the body 210 formed in the eggplant shape is installed while being wound around a crime prevention window of a building, thereby making it possible to sense that an invader removes or cuts the crime prevention window.

However, the accompanying drawings are only examples shown in order to describe the technical idea of the present invention in more detail. Therefore, the technical idea of the present invention is not limited to shapes of the accompanying drawings.

The present invention is not limited to the above-mentioned exemplary embodiments, and may be variously applied, and may be variously modified without departing from the gist of the present invention claimed in the claims.

The invention claimed is:

1. A crime prevention system using a sensor module for sensing inclination in all directions, comprising:

a plurality of sensor modules installed at areas in which a structure is to be monitored; and a central control unit transmitting control signals to the plurality of sensor modules to individually control the plurality of sensor modules and receiving alarm signals from the plurality of sensor modules to provide an audible alarm, wherein each of the plurality of sensor modules includes:

a module controlling unit controlling components of the sensor module and processing signals transmitted and received to and from the components of the sensor module;

a multi-sensor unit including a body and a plurality of inclination sensors coupled to an outer surface of the body and sensing the inclination in all directions;

a multi-switch unit including switches closed or opened, respectively, under a control of the module controlling unit and connected to the plurality of inclination sensors by electric wires, respectively, and generating the alarm signal and transmitting the generated alarm signal to the module controlling unit when it confirms when the plurality of inclination sensors sense the inclination; and a cutting sensor unit sensing that the electric wires are cut, and generating the alarm signal and transmitting the generated alarm signal to the module controlling unit when it senses that the electric wires are cut, and wherein the plurality of inclination sensors are formed of a multi-pole ball switch including a pair of separated conductors attached to both ends of an inner surface thereof and a conductor ball freely rolling therein, and the conductor ball is in the short-circuit (ON) state or the disconnection (OFF) state depending on positions and directions at and in which they are installed, wherein the body of the multi-sensor unit is formed in the spherical shape, and the plurality of inclination sensors are coupled to an outer surface of the body radially.

2. The crime prevention system using a sensor module of claim 1, wherein the sensor module further includes the external case enclosing the multi-sensor unit.

3. The crime prevention system using a sensor module of claim 1, wherein the multi-switch unit individually inputs an initial short-circuit (ON) state or an initial disconnection (OFF) state of each of the plurality of inclination sensors, and generates the alarm signal and transmits the generated alarm signal to the module controlling unit when a state of at least one of the plurality of inclination sensors is changed due to impact from the outside.

4. The crime prevention system using a sensor module of claim 1, wherein the sensor module further includes:

a command input unit connected to the module controlling unit to receive control commands for the components of the sensor module;

a first audible alarm unit connected to the module controlling unit to receive the alarm signal from the module controlling unit and generate an alarm lamp and an alarm sound;

a timer unit connected to the module controlling unit to set the sensor module to be operated for a determined time; and a password unit connected to the first audible alarm unit to set a password in the first audible alarm unit and stop an operation of the first audible alarm unit when the set password is input.

5. The crime prevention system using a sensor module of claim 4, wherein the command input unit receives an operation command, a stop command, and a release command for the sensor module.

6. The crime prevention system using a sensor module of claim 1, wherein the sensor module further includes a module communication unit receiving the control signal from the central control unit, transmitting the received control signal to the module controlling unit, receiving the alarm signal from the module controlling unit, and transmitting the received alarm signal to the central control unit.

7. The crime prevention system using a sensor module of claim 6, wherein the central control unit includes:

an interface receiving control commands and information;

a general controlling unit controlling components of the central control unit, processing signals transmitted and received to and from the components of the central control unit, storing the information input to the interface, and receiving the control commands from the interface and converting the received control commands into control signals;

an internal communication unit receiving the alarm signals from the plurality of sensor modules, transmitting the received alarm signals to the general controlling unit, receiving the control signals from the general controlling unit, and transmitting the received control signals to the module communication unit;

an external communication unit receiving the alarm signals from the general controlling unit and transmitting the received alarm signals to an external communication network;

a second audible alarm unit generating an alarm lamp and an alarm sound when it receives the alarm signals from the general controlling unit;

an image recording unit storing an alarm situation as a photograph or a moving picture when it receives the alarm signals from the general controlling unit; and an alarm forwarding unit forwarding alarm fact through using a text message or an e-mail when it receives the alarm signals from the general controlling unit.

8. The crime prevention system using a sensor module of claim 7, wherein the interface receives individual operation start commands, operation stop commands, and operation end commands of the plurality of sensor modules and operation start commands, operation stop commands, and operation end commands for the second audible alarm unit, the image recording unit, and the alarm forwarding unit and receives information on a phone number, an e-mail address, and a homepage address.

9. A crime prevention method by the crime prevention system using a sensor module of claim 7, comprising:

an installing step of installing the sensor module and the central control unit in a structure;

a setting step of confirming and inputting, by the multi-switch unit, a short-circuit (ON) or a disconnection (OFF) state of the plurality of the inclination sensors under a control of the module controlling unit;

a sensing step of sensing, by the multi-sensor unit, inclination in at least any one of all directions or sensing, by the cutting sensor unit, that the electric wires are cut;

an alarm signal generating step of generating, by the multi-switch unit, the alarm signal in the case in which the multi-sensor unit recognizes the inclination or generating, by the cutting sensor unit that the electric wires are cut, the alarm signal;

an alarm signal transmitting step of sequentially transmitting the alarm signal to the module controlling unit, the module communication unit, the internal communication unit, and the general controlling unit;

an alarm preparing step of transmitting the transmitted alarm signal to the external communication unit, the second audible alarm unit, the image recording unit, and the alarm forwarding unit; and an alarming step of transmitting the alarm signal to the external communication network, generating the alarm lamp and the alarm sound, storing the alarm situation as the photograph or the moving picture, and forwarding the alarm fact through using the text message or the e-mail.

* * * * *